US009302897B2

(12) United States Patent
Dherde

(10) Patent No.: US 9,302,897 B2
(45) Date of Patent: Apr. 5, 2016

(54) METHODS AND APPARATUS TO CHILL DISPENSED BEVERAGES IN REFRIGERATORS

(71) Applicant: Whirlpool Corporation, Benton Harbor, MI (US)

(72) Inventor: Eric J. Dherde, Grand Blanc, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 46 days.

(21) Appl. No.: 14/452,886

(22) Filed: Aug. 6, 2014

(65) Prior Publication Data

US 2016/0039652 A1 Feb. 11, 2016

(51) Int. Cl.

| | |
|---|---|
| ***B67D 1/00*** | (2006.01) |
| ***F25D 31/00*** | (2006.01) |
| ***B67D 1/08*** | (2006.01) |

(52) U.S. Cl.

CPC ..... *B67D 1/0014* (2013.01); *B67D 1/0857* (2013.01); *B67D 1/0884* (2013.01); *F25D 31/002* (2013.01)

(58) Field of Classification Search

CPC .. B67D 1/0014; B67D 1/0857; B67D 1/0884; F25D 31/002; F25D 31/006; F25D 31/00

USPC ..... 222/54, 146.6, 146.1; 62/389, 337–339

See application file for complete search history.

(56) References Cited

U.S. PATENT DOCUMENTS

| | | | | |
|---|---|---|---|---|
| 3,914,957 | A * | 10/1975 | Jacobs | F25B 25/005 165/104.21 |
| 4,036,620 | A * | 7/1977 | Benasutti | F25D 23/126 222/146.6 |
| 5,766,453 | A | 6/1998 | Morellato et al. | |
| 5,819,547 | A | 10/1998 | Oh | |
| 6,973,803 | B2 | 12/2005 | Olive | |
| 7,188,486 | B2 | 3/2007 | Olive | |
| 7,207,189 | B2 * | 4/2007 | An | B01D 35/18 165/63 |
| 7,596,964 | B2 | 10/2009 | Lim et al. | |
| 7,814,763 | B2 | 10/2010 | Tavolazzi et al. | |
| 7,856,832 | B2 | 12/2010 | Lim et al. | |
| 8,083,104 | B2 | 12/2011 | Roetker et al. | |
| 8,397,952 | B2 * | 3/2013 | Kim | F25D 23/126 222/146.1 |
| 2006/0202072 | A1 * | 9/2006 | Lee | F25C 5/007 241/101.2 |
| 2012/0104021 | A1 * | 5/2012 | Cur | F25D 23/126 62/389 |
| 2014/0157810 | A1 * | 6/2014 | Jang | F25D 23/126 62/129 |

* cited by examiner

*Primary Examiner* — Lien Ngo

(57) ABSTRACT

Example methods and apparatus to chill beverages in refrigerators at a faster rate than existing solutions, which use a tank in a refrigerating compartment for chilling, are disclosed. An example refrigerator includes a freezing compartment, a refrigerating compartment, a dispenser, a first tank in the freezing compartment fluidly coupled to a supply, and a second tank in the refrigerating compartment fluidly coupled to the first tank and to the dispenser. The refrigerator may further include a temperature sensor associated with the first tank, and a controller configured to transfer a beverage in its liquid state from the first tank to the second tank when the temperature sensor indicates the temperature of the beverage in its liquid state in the first tank meets a criterion.

20 Claims, 5 Drawing Sheets

METHODS AND APPARATUS TO CHILL DISPENSED BEVERAGES IN REFRIGERATORS

FIELD OF THE DISCLOSURE

This disclosure relates generally to refrigerators, and, more particularly, to methods and apparatus to chill dispensed beverages in refrigerators.

BACKGROUND

Increasingly, refrigerators have a dispenser that discharges, for example, beverages, ice, etc. Beverages are stored in a tank in the refrigerating compartment to chill the beverages prior to dispensing.

SUMMARY

Example methods and apparatus to chill dispensed beverages in refrigerators at a faster rate than existing solutions, which use a tank in a refrigerating compartment for chilling, are disclosed. An example refrigerator includes a freezing compartment, a refrigerating compartment, a dispenser, a first tank in the freezing compartment fluidly coupled to a supply, and a second tank in the refrigerating compartment fluidly coupled to the first tank and to the dispenser. The refrigerator may further include a temperature sensor associated with the first tank, and a controller configured to transfer a beverage in its liquid state from the first tank to the second tank when the temperature sensor indicates the temperature of the beverage in its liquid state in the first tank meets a criterion.

DETAILED DESCRIPTION

Figure 1:
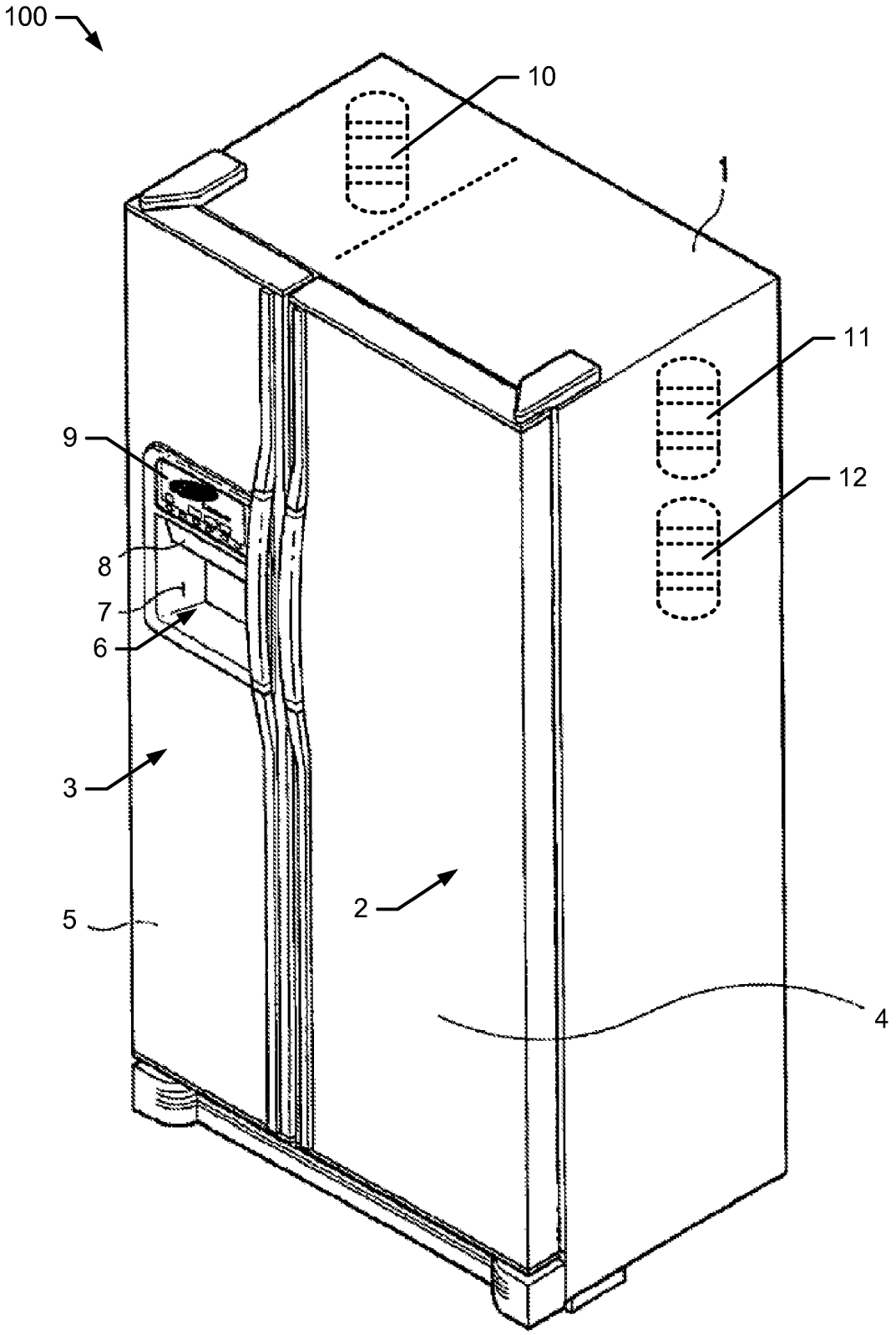
FIG. 1 is an isometric perspective view of an example refrigerator including a beverage chilling apparatus constructed in accordance with the teachings of this disclosure.

The methods and apparatus to chill beverages in refrigerators disclosed herein may be used to chill any number and/or type(s) of potable liquids, such as water, flavorings, beverages, etc. However, for ease of discussion, the examples disclosed herein will be described with reference to water. Further, the examples disclosed herein may be used to chill water to any temperature between the incoming water temperature and the freezer compartment temperature depending on, for example, user preference, intended use, manufacturing specification, etc. Moreover, for ease of discussion, reference will be made herein to "chilling," or permutations thereof. It should be recognized that many other words, such as, but not limited to, "cool," having meanings similar to "chill," and could have alternatively been used.

Any use of relative terms, such as quickly, rapidly, fast, etc., when describing the disclosed examples are only used to indicate that the disclosed examples are able to chill water at a faster rate than a conventional prior art solution. Such terms are not to be construed as requiring or specifying that water be chilled at a particular rate. For example, the rate at which water can be chilled depends on, for example, incoming water temperature, ambient temperature, and freezing compartment temperature, the particular values of which are, and need not be, specified herein.

Moreover, terms such as, but not limited to, approximately, substantially, etc. are used herein to indicate that a precise value is not required, need not be specified, etc. For example, a first value being approximately a second value means that from a practical implementation perspective they can be considered as if equal. As used herein, such terms will have ready and instant meaning to one of ordinary skill in the art.

In this specification and the appended claims, the singular forms "a," "an" and "the" do not exclude the plural reference unless the context clearly dictates otherwise. Further, conjunctions such as "and," "or," and "and/or" are inclusive unless the context clearly dictates otherwise. For example, "A and/or B" includes A alone, B alone, and A with B. Further still, connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the embodiments disclosed herein unless the element is specifically described as "essential" or "critical".

Due to the laws of physics, there are only a few ways to reduce the temperature of a material. Traditional ways, which have been explored in depth, include the use of fans and fins to increase the heat transfer coefficient, and to increase the heat transfer area. Fans and fins require additional components and electrical wiring capable of delivering a significant amount of power to the fan. An increased area helps increase the availability of chilled water, but does not reduce the recovery time to reach the desired temperature.

To overcome at least the deficits of prior art solutions, the examples disclosed herein utilize a tank in a freezing compartment to chill water. By chilling water in the freezing compartment instead of a refrigerating compartment, a higher delta T (on the order of 30 Kelvins (K) instead of 10 K) is realized, thereby chilling water approximately 3 times faster. This cooling rate increase is comparable to that of a system with a fan and fins, but without the complexity. Compared to prior art solutions, the examples disclosed herein only require an additional tank, a thermal probe or a timer, and an additional electrovalve.

Reference will now be made in detail to embodiments of this disclosure, examples of which are illustrated in the accompanying drawings. The embodiments are described below by referring to the drawings, wherein like reference numerals refer to like elements. Here, configurations of an example refrigerator according to the disclosure will be described with reference to FIG. 1. While the examples disclosed herein are described and illustrated with reference to a side-by-side refrigerator, those of ordinary skill in the art will recognize that the methods and apparatus to chill dispensed water disclosed herein may be implemented in, for example, french-door bottom-mount refrigerators and/or any other configuration(s) of refrigerator having a water dispenser and freezing compartment.

FIG. 1 is an isometric perspective view of an example refrigerator 100 in which the methods and apparatus for chilling dispensed beverages in refrigerators according to this disclosure are implemented. The example refrigerator 100 includes a main cabinet 1 partitioned into a refrigerating compartment 2 and a freezing compartment 3 having respective front openings. A refrigerating compartment door 4 and a freezing compartment door 5 respectively open and close the respective front openings of the refrigerating and freezing compartments 2, 3.

In the front of the freezing compartment door 5 is formed a dispenser 6 having a dispensing part 7 that is typically recessed to accommodate a container to receive, for example, chilled water and ice, for consumption by a person or animal. The dispensing part 7 includes a discharging lever 8 to be operated for obtaining, for example, ice and chilled water. The discharging lever 8 is, for example, rotatable forward and backward inside the dispensing part 7. Alternatively, a user interface 9 may be used to obtain ice and water. An example user interface 9 includes a capacitive touch area, although other types of user interface elements may of course be used. While in the example of FIG. 1 the dispenser 6 is formed in the freezing compartment door 5, the dispenser 6 may be located elsewhere. For example, in the refrigerator compartment door 4, inside the refrigerator compartment 2, inside the freezing compartment 3, etc.

To chill water more quickly and in greater quantities, the example refrigerator 100 of FIG. 1 includes a beverage chilling apparatus constructed in accordance with the teachings of this disclosure. As will be described in more detail in connection with FIGS. 2-4, the beverage chilling apparatus includes a beverage tank 10 in the freezing compartment 3 to chill water, and two beverage tanks 11 and 12 in the refrigerating compartment 2. In general, incoming supply water flows into the beverage tank 10 in the freezing compartment 3, where it is quickly chilled to approximately the temperature of the refrigerating compartment 2. The chilled water then flows into the tank 11, where it is held until the tank 12 at least partially empties. Water remains in the tank 10 long enough to be chilled to a desired temperature, but preferably not long enough to freeze. When to transfer the chilled water from the tank 10 to the tank 11 may be determined using, for example, a temperature sensor 21 or a timer 22 (see FIG. 2). Chilled water flows from the tank 11 to the tank 12 as the chilled water is dispensed. When the lever 8 is activated, chilled water flows from the tank 12 to the dispenser 6. Because the water is chilled in the tank 10 in the freezing compartment 3, it is chilled at faster rate than if chilled in the refrigerating compartment 2.

In some examples, gravity is used to move water from the tank 10 to the tank 11, from the tank 11 to the tank 12, and from the tank 12 to the dispenser 6. For example, the tank 10 may be positioned higher in the refrigerator than the tank 11, the tank 11 positioned higher than the tank 12, and the tank 12 positioned higher than the dispenser 6. Of course, other arrangements of the tanks 10-12 and the dispenser 6 may be used with, for example, pumps or pressure bladders utilized as needed. For example, for a refrigerator having a bottom-mount freezer, a pump may be used to move the chilled water from a freezing compartment to a refrigerating compartment.

Figure 2:
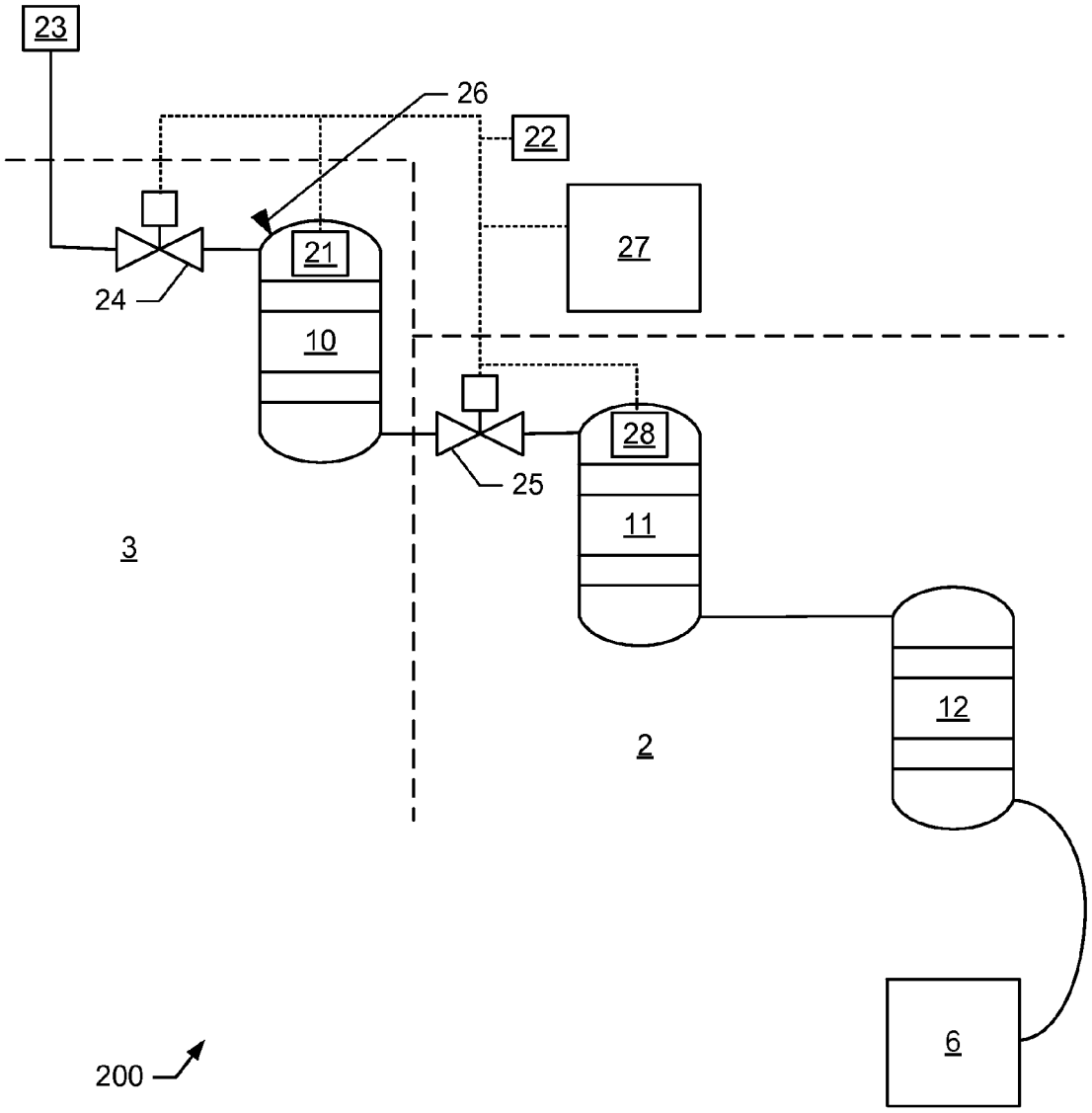
FIG. 2 is a schematic diagram illustrating an example manner of implementing the example beverage chilling apparatus of FIG. 1.

FIG. 2 is a schematic diagram illustrating an example manner of implementing a beverage chilling apparatus 200 for the example refrigerator 100 of FIG. 1. The example beverage chilling apparatus 200 of FIG. 2 includes the example tank 10 in the freezing compartment 3, and the example tanks 11 and 12 in the refrigerating compartment 2. In the example of FIG. 2, the tank 10 is selectively fluidly coupled to a supply 23 via a valve 24 and associated tubing and/or supply line(s); the tank 10 is selectively fluidly coupled to the tank 11 via a valve 25 and associated tubing and/or supply line(s); the tank 11 it fluidly coupled to the tank 12 via associated tubing and/or supply line(s); and the tank 12 is fluidly coupled to the dispenser 6 via associated tubing and/or supply line(s). The example tank 10 includes a vent 26 to avoid airlock conditions that could prevent the tank 10 from fully filling and/or emptying. As desired, the tanks 11 and 12 may also include vents. Any suitable vent(s), tubing, supply line(s) and/or valve(s) may be used. Of course, other arrangement(s) and/or number (s) of tanks, with at least one tank in the freezing compartment 3, are contemplated. The supply 23 may be, for example, a domestic water supply, a filtered domestic water supply, etc.

As used herein, fluidly coupled refers to the coupling of, for example, two devices so that a fluid in its liquid state may be flowed, transferred or otherwise moved between the two devices. Moreover, the potable liquids referred to herein are flowed, transferred or otherwise moved in their liquid state.

To control the operation(s) of the example beverage chilling apparatus 200, the beverage chilling apparatus 200 includes a controller 27. The example controller 27 of FIG. 2 controls the beverage chilling apparatus 200 by controlling and/or operating the valves 24, 25 in response to, possibly among other things, temperature values received from the temperature sensor 21 that represent the temperature of water in the tank 10, level values received from a level sensor 28 associated with the tank 11 that represent the depth, level or amount of water in the tank 11, and/or the timer 22. The controller 27 may also implement, carry out and/or otherwise perform any number and/or type(s) of additional methods and/or functions associated with the refrigerator 100. In the example of FIG. 2, the valves 24 and 25 are electrovalves (e.g., solenoid valves) electrically controllable by the controller 27. The controller 26 may be communicatively coupled to the valves 24, 25, the sensors 21, 28, and the timer 22 via any number and/or type(s) of bus(es), wire(s), architecture(s), protocol(s), packet(s), standard(s), etc.

Figure 3:
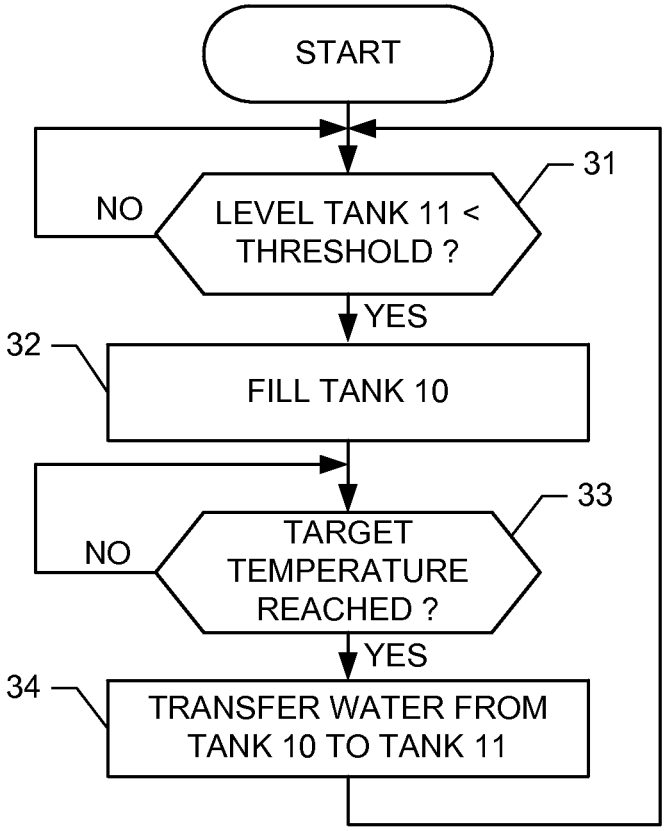
FIG. 3 is a flowchart illustrating an example method that may be performed or carried out to control the example beverage chilling apparatus of FIGS. 1 and 2.
Figure 4A:
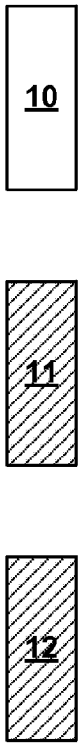
FIGS. 4A-D illustrate example operations of the example beverage chilling apparatus of FIGS. 1 and 2.
Figure 4B:
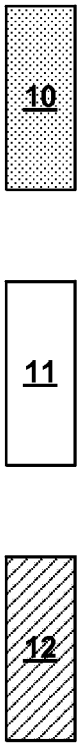
Figure 4C:
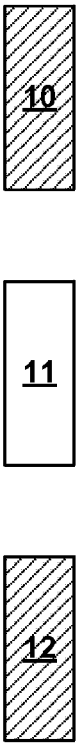
Figure 4D:
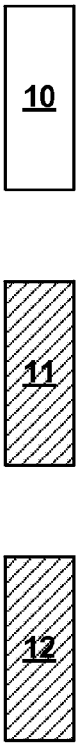

FIG. 3 is a flowchart illustrating an example method that may be performed and/or carried out by, for example, the example controller 27 to control and/or operate the example beverage cooling apparatus 200 of FIG. 2. Starting with, forsake of discussion, the tank 10 empty and the tanks 11 and 12 filled with chilled water, see FIG. 4A, the example method of FIG. 3 begins with the controller 27 waiting for a level value received from the level sensor 28 to indicate or represent that the level of water in the tank 11 meets a level criterion, see FIG. 4B (block 31). An example criterion is the level falls below a predetermined level, or the tank 11 is approximately empty. When the level criterion is satisfied (block 31), the controller 27 closes the valve 25 and opens the valve 24 to fill the tank 10 in the freezing compartment 3 with water from the supply 23, see FIG. 4C (block 32). When a criterion is met or satisfied, the controller 27 opens the valve 25 to transfer the chilled water from the tank 10 in the freezing compartment 3 to the tank 11 in the refrigerating compartment 2, see FIG. 4D (block 34). An example criterion is a temperature value received from the temperature sensor 21 indicating or representing that the temperature of the water in the tank 10 meets a temperature criterion (block 33). An example temperature criterion is the temperature is approximately the temperature of the refrigerating compartment 2. Additionally or alternatively, the timer 22 may be used to at block 34 as a criterion to determine when to transfer the chilled water from the tank 10 to the tank 11. Control then returns to block 31 to monitor the level of water in the tank 11.

The exemplary methods disclosed herein (e.g., the example method of FIG. 3) may be implemented as machine-readable instructions carried out by one or more processors to implement the example controller 27 of FIG. 2. A processor, a controller and/or any other suitable processing device may be used, configured and/or programmed to execute and/or carry out the disclosed methods. For example, the disclosed methods may be embodied in program code and/or machine-readable instructions stored on a tangible and/or non-transitory computer-readable medium accessible by a processor, a computer and/or other machine having a processor such as the example processor platform P100 of FIG. 5. Machine-readable instructions comprise, for example, instructions that cause a processor, a computer and/or a machine having a processor to perform one or more particular processes. Alternatively, some or all of the disclosed methods may be implemented using any combination(s) of fuses, application-specific integrated circuit(s) (ASIC(s)), programmable logic device(s) (PLD(s)), field-programmable logic device(s) (FPLD(s)), field programmable gate array(s) (FPGA(s)), discrete logic, hardware, firmware, etc. Also, some or all of the disclosed methods may be implemented using any combination of any of the foregoing techniques, for example, any combination of firmware, software, discrete logic and/or hardware. Further, many other methods of implementing the disclosed methods may be employed. For example, the order of execution may be changed, and/or one or more of the blocks and/or interactions described may be changed, eliminated, sub-divided, or combined. Additionally, any or the entire disclosed methods may be carried out sequentially and/or carried out in parallel by, for example, separate processing threads, processors, devices, discrete logic, circuits, etc.

As used herein, the term "computer-readable medium" is expressly defined to include any type of computer-readable medium and to expressly exclude propagating signals. Example computer-readable medium include, but are not limited to, a volatile and/or non-volatile memory, a volatile and/or non-volatile memory device, a compact disc (CD), a digital versatile disc (DVD), a read-only memory (ROM), a random-access memory (RAM), a programmable ROM (PROM), an electronically-programmable ROM (EPROM), an electronically-erasable PROM (EEPROM), an optical storage disk, an optical storage device, a magnetic storage disk, a magnetic storage device, a cache, and/or any other storage media in which information is stored for any duration (e.g., for extended time periods, permanently, brief instances, for temporarily buffering, and/or for caching of the information) and that can be accessed by a processor, a computer and/or other machine having a processor, such as the example processor platform P100 discussed below in connection with FIG. 5.

Figure 5:
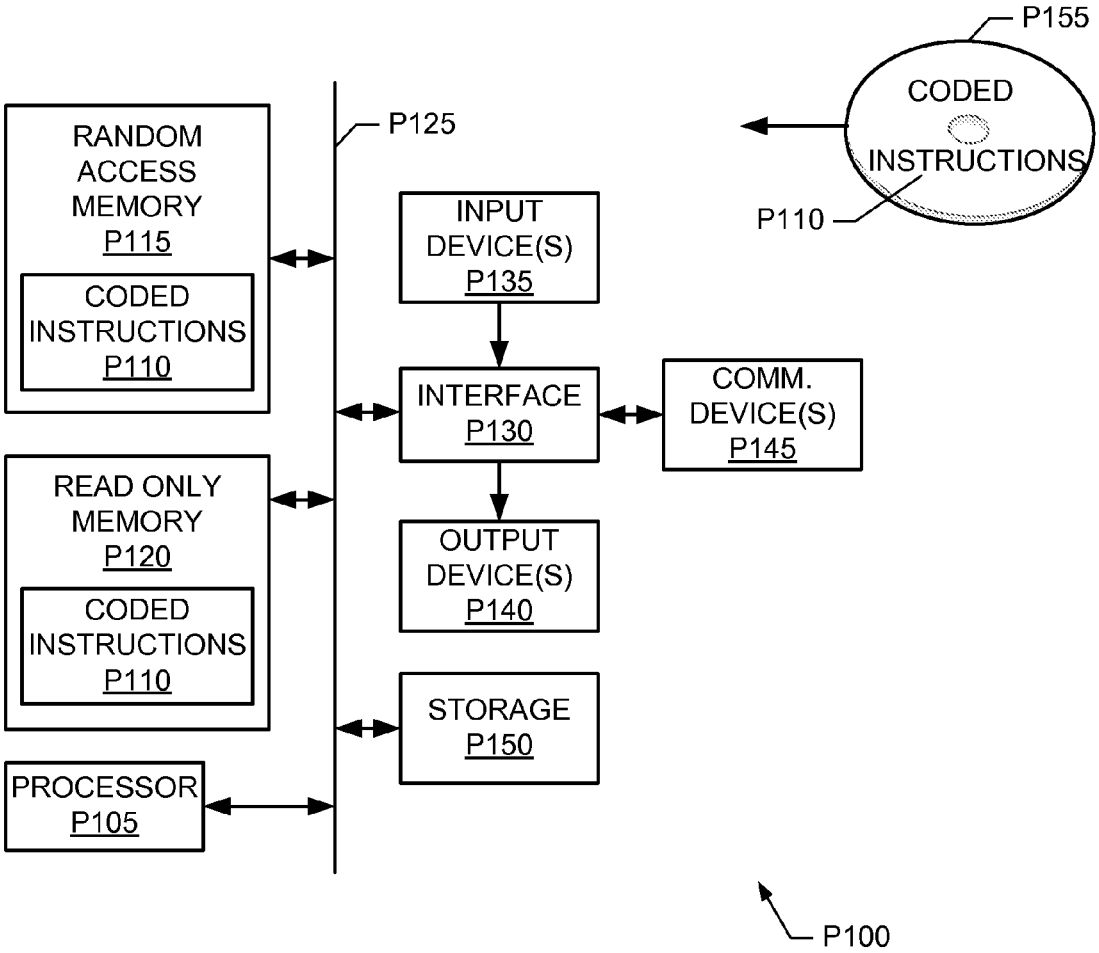
FIG. 5 is a schematic illustration of an example processor platform that may be used and/or programmed to implement the example controller of FIG. 2 and/or to execute the example methods disclosed herein.

FIG. 5 illustrates an exemplary processor platform P100 capable of executing, performing and/or otherwise carrying out at least the example methods disclosed herein (e.g., the example method of FIG. 3) to implement the example controller 27 of FIG. 2. The exemplary processor platform P100 can be, for example, any type of computing device containing a processor.

The processor platform P100 of the instant example includes at least one programmable processor P105. For example, the processor P105 can be implemented by one or more Atmel®, Intel®, AMD®, and/or ARM® microprocessors. Of course, other processors from other processor families and/or manufacturers are also appropriate. The processor P105 executes coded instructions P110 present in main memory of the processor P105 (e.g., within a volatile memory P115 and/or a non-volatile memory P120), stored on a storage device P150, stored on a removable computer-readable storage medium P155 such as a CD, a DVD and/or a FLASH drive. The processor P105 may execute, among other things, the disclosed methods. Thus, the coded instructions P110 may include instructions corresponding to the disclosed methods.

The processor P105 is in communication with the main memory including the non-volatile memory P120 and the volatile memory P115, and the storage device P150 via a bus P125. The volatile memory P115 may be implemented by, for example, synchronous dynamic random access memory (SDRAM), dynamic random access memory (DRAM), RAMBUS® dynamic random access memory (RDRAM) and/or any other type of RAM device(s). The non-volatile memory P120 may be implemented by, for example, flash memory(-ies), flash memory device(s) and/or any other desired type of memory device(s). Access to the memory P115 and P120 may be controlled by a memory controller.

The processor platform P100 also includes an interface circuit P130. Any type of interface standard, such as an external memory interface, serial port, general-purpose input/output, as an Ethernet interface, a universal serial bus (USB), and/or a peripheral component interface (PCI) express interface, etc, may implement the interface circuit P130.

One or more input devices P135 are connected to the interface circuit P130. The input device(s) P135 permit a user to enter data and commands into the processor P105. The input device(s) P135 can be implemented by, for example, the knobs 30, a keyboard, a mouse, a touchscreen, a capacitive touch area, a track-pad, a trackball, an isopoint and/or a voice recognition system. The input device(s) P135 may also implement the user interface 9, the temperature sensor 21, the timer 22 and/or the level sensor 28.

One or more output devices P140 are also connected to the interface circuit P130. The output devices P140 can be implemented, for example, by display devices (e.g., a display, indicators, light emitting diodes, and/or speakers). The output devices P140 may also include the user interface 9 and/or the valves 24, 25.

The interface circuit P130 may also includes one or more communication device(s) P145 such as a network interface card to facilitate exchange of data with other appliances, devices, computers, nodes and/or routers of a network.

Although certain example methods, apparatus and articles of manufacture have been described herein, the scope of coverage of this patent is not limited thereto. On the contrary, this patent covers all methods, apparatus and articles of manufacture fairly falling within the scope of the claims of this patent.

What is claimed is:

1. A refrigerator comprising:

a freezing compartment;

a refrigerating compartment;

a dispenser;

a first tank in the freezing compartment fluidly coupled to a supply; and a second tank in the refrigerating compartment fluidly coupled to the first tank and to the dispenser.

2. A refrigerator as defined in claim 1, wherein:

the dispenser is configured to dispense a chilled potable liquid in its liquid state into a container, the potable liquid intended for consumption by a person;

the first tank is configured to receive the potable liquid in its liquid state from the supply, and to chill the potable liquid to approximately a temperature associated with the refrigerating compartment while retaining the potable liquid in its liquid state; and the second tank is configured to receive the chilled potable liquid in its liquid state from the first tank, and provide the chilled potable liquid in its liquid state to the dispenser.

3. A refrigerator as defined in claim 1, further comprising:

a level sensor associated with the second tank;

a first valve to selectively fluidly couple the supply to the first tank; and a controller configured to at least operate the first valve to transfer a beverage from the supply to the first tank when the level sensor indicates the level of the beverage in the second tank is below a predetermined level.

4. A refrigerator as defined in claim 3, further comprising:

a temperature sensor associated with the first tank; and a second valve to selectively fluidly couple the first tank to the second tank, wherein the controller is further configured to operate the second valve to transfer the beverage from the first tank to the second tank when the temperature sensor indicates the temperature of the beverage in the first tank meets a criterion.

5. A refrigerator as defined in claim 4, wherein the criterion is met when the temperature of the beverage in the first tank is approximately a temperature associated with the refrigerating compartment.

6. A refrigerator as defined in claim 4, further comprising a third tank in the refrigerating compartment fluidly coupled between the second tank and to the dispenser, wherein a beverage is transferred from the second tank to the third tank as the beverage is dispensed at the dispenser.

7. A refrigerator as defined in claim 5, wherein the controller is further configured to close the first valve and open the second valve during a period of time when the beverage is being dispensed at the dispenser.

8. A refrigerator as defined in claim 4, wherein the first and second valves comprise electrovalves electrically operated by the controller.

9. A refrigerator as defined in claim 3, further comprising a second valve to selectively fluidly couple the first tank to the second tank, wherein the controller is further configured to operate the second valve to transfer the beverage from the first tank to the second tank a predetermined period of time after the beverage is transferred from the supply to the first tank.

10. A refrigerator as defined in claim 1, further comprising:

a temperature sensor associated with the first tank; and a controller configured to at least transfer a beverage from the first tank to the second tank when the temperature sensor indicates the temperature of the beverage in the first tank meets a criterion.

11. A refrigerator as defined in claim 1, further comprising a controller configured to at least transfer a beverage from the first tank to the second tank a predetermined period of time after the beverage is transferred from the supply to the first tank.

12. A refrigerator as defined in claim 1, further comprising a third tank in the refrigerating compartment fluidly coupled between the second tank and to the dispenser, wherein a beverage is transferred from the second tank to the third tank as the beverage is dispensed at the dispenser.

13. A method of chilling a beverage in a refrigerator having a freezing compartment, a refrigerating compartment, and a dispenser, the method comprising:

transferring a beverage in its liquid state from a supply to a first tank located within the freezing compartment;

maintaining the beverage in its liquid state while in the first tank;

transferring the beverage in its liquid state from the first tank to a second tank located within the refrigerating compartment when a criterion is satisfied; and transferring the beverage in its liquid state from the second tank to the dispenser for dispensing into a user's container.

14. A method of chilling as defined in claim 13, wherein the criterion comprises a temperature criterion.

15. A method of chilling as defined in claim 13, further comprising transferring the beverage from the supply to the first tank when the level of the beverage in the second tank is below a predetermined level.

16. A method of chilling as defined in claim 13, wherein transferring the beverage from the first tank to the second tank comprising transferring the beverage to a third tank fluidly coupled between the first and second tanks.

17. A method of chilling as defined in claim 13, wherein the beverage is transferred from the supply to the first tank while the beverage is being dispensed at the dispenser.

18. A method of chilling as defined in claim 13, wherein transferring the beverage from the supply to the first tank comprising operating a first valve, and wherein transferring the beverage from the first tank to the second tank comprises operating a second valve.

19. A refrigerator comprising:

a freezing compartment;

a refrigerating compartment;

a dispenser;

a first tank in the freezing compartment;

a first valve selectively fluidly coupling a supply and the first tank;

a temperature sensor associated with the first tank;

second and third tanks in the refrigerating compartment;

a second valve selectively fluidly coupling the first and second tanks;

a level sensor associated with the second tank;

a first line fluidly coupling the second and third tanks;

a second line fluidly coupling the third tank and the dispenser; and a circuit configured to at least:

operate the first valve to flow a potable liquid in its liquid state from the supply to the first tank when the level sensor indicates the level of the potable liquid in the second tank is below a predetermined level;

maintain the potable liquid in its liquid state while in the first tank; and operate the second valve to flow the potable liquid in its liquid state from the first tank to the second tank when the temperature sensor indicates the temperature of the potable liquid in the first tank meets a criterion.

20. A refrigerator as defined in claim 19, wherein the circuit comprises:

a processor; and a tangible article of manufacture storing machine-readable instructions that, when executed, cause the processor to at least:

operate the first valve to flow the potable liquid in its liquid state from the supply to the first tank when the level sensor indicates the level of the potable liquid in the second tank is below the predetermined level;

maintain the potable liquid in its liquid state while in the first tank; and operate the second valve to flow the potable liquid in its liquid state from the first tank to the second tank when the temperature sensor indicates the temperature of the potable liquid in the first tank meets the criterion.

* * * * *